US011918082B1

(12) United States Patent
Cheney et al.

(10) Patent No.: US 11,918,082 B1
(45) Date of Patent: Mar. 5, 2024

(54) ARCH ADJUSTABLE FOOTBEDS FOR FOOTWEAR

(71) Applicant: FAST IP, LLC, Vineyard, UT (US)

(72) Inventors: Craig Cheney, Lindon, UT (US); Seth Munger, Springville, UT (US); Aislynn Edwards, Schenectady, NY (US)

(73) Assignee: FAST IP, LLC, Lindon, UT (US)

( * ) Notice: Subject to any disclaimer, the term of this patent is extended or adjusted under 35 U.S.C. 154(b) by 25 days.

(21) Appl. No.: 17/143,925

(22) Filed: Jan. 7, 2021

Related U.S. Application Data

(60) Provisional application No. 62/958,302, filed on Jan. 7, 2020.

(51) Int. Cl.
*A43B 7/1464* (2022.01)
*A43B 7/142* (2022.01)

(52) U.S. Cl.
CPC ..... *A43B 7/1464* (2022.01); *A43B 7/142* (2013.01)

(58) Field of Classification Search
CPC ..... A43B 7/142
See application file for complete search history.

(56) References Cited

U.S. PATENT DOCUMENTS 1,311,240 A * 7/1919 Mayer ..... A43B 7/1464 36/157
1,830,648 A 11/1931 Engel
2,112,052 A 3/1938 Smith
2,776,499 A 1/1957 Guintini
2,779,110 A * 1/1957 Howell ..... A43B 7/1464 36/156
3,541,708 A 11/1970 Rosen
4,083,128 A 4/1978 Rossman
4,813,157 A 3/1989 Boisvert et al.
4,968,492 A 11/1990 Rosen
5,036,604 A 8/1991 Rosen
5,203,096 A 4/1993 Rosen
5,241,762 A 9/1993 Rosen
5,768,803 A 6/1998 Levy
5,813,146 A 9/1998 Gutkowski et al.
6,000,147 A 12/1999 Kellerman
6,345,455 B1 * 2/2002 Greer, Jr. ..... A61F 5/14 36/161
6,442,874 B1 9/2002 Long
6,450,510 B1 9/2002 Liu
6,804,902 B1 * 10/2004 McCracken ..... A61F 5/14 36/161
6,920,707 B1 7/2005 Greene et al.
7,055,268 B2 6/2006 Ha
7,225,563 B2 6/2007 Chen et al.
7,392,604 B2 7/2008 Greene et al.
7,610,696 B2 11/2009 Davis
7,634,861 B2 12/2009 Kilgore
7,917,981 B1 4/2011 Lakic
(Continued)

FOREIGN PATENT DOCUMENTS

CH 150596 A * 11/1931
CN 203969442 U 12/2014
(Continued)

*Primary Examiner* — Megan E Lynch

(57) ABSTRACT

The present disclosure relates to a footbed for an article of footwear, the footbed having an arch portion defined by a curve, wherein a height of the curve is adjustable to increase or decrease the height of the arch portion.

11 Claims, 1 Drawing Sheet

(56) References Cited

U.S. PATENT DOCUMENTS

| | | | | |
|---|---|---|---|---|
| 9,301,571 | B2 | 4/2016 | Langvin | |
| 9,491,983 | B2 | 11/2016 | Rushbrook | |
| 9,808,045 | B2 | 11/2017 | Carlson et al. | |
| 10,159,302 | B2 | 12/2018 | Carlson et al. | |
| 10,499,707 | B2 | 12/2019 | Hobson et al. | |
| 10,588,382 | B2 | 3/2020 | Rushbrook | |
| 10,602,797 | B2 | 3/2020 | Lintaman | |
| 10,645,990 | B2 | 5/2020 | Rushbrook | |
| 10,667,579 | B2 | 6/2020 | Elder et al. | |
| 10,736,379 | B2 | 8/2020 | Cook et al. | |
| 10,765,170 | B2 | 9/2020 | Langvin et al. | |
| 10,765,175 | B2 | 9/2020 | Panian et al. | |
| 10,779,607 | B1 | 9/2020 | Chandel | |
| 10,827,800 | B2 | 11/2020 | Iannuzzi | |
| 10,827,803 | B2 | 11/2020 | Bell et al. | |
| 10,959,484 | B1 * | 3/2021 | Tarlton | A43B 17/04 |
| 11,033,072 | B2 | 6/2021 | Oda | |
| 11,044,962 | B2 | 6/2021 | Cheung | |
| 2002/0178614 | A1 | 12/2002 | Issler | |
| 2004/0064974 | A1 * | 4/2004 | Schuster | A43B 1/0045 36/155 |
| 2005/0060913 | A1 | 3/2005 | Chil et al. | |
| 2006/0107552 | A1 | 5/2006 | Clark et al. | |
| 2006/0162191 | A1 | 7/2006 | Mason | |
| 2008/0127518 | A1 | 6/2008 | Byrne et al. | |
| 2008/0178493 | A1 | 7/2008 | Scofield | |
| 2009/0172972 | A1 | 7/2009 | Rosen | |
| 2011/0185600 | A1 | 8/2011 | Malek | |
| 2013/0152426 | A1 | 6/2013 | Lederer | |
| 2013/0219744 | A1 * | 8/2013 | Case | A43B 17/023 36/43 |
| 2013/0318818 | A1 * | 12/2013 | Gardiner | A61F 5/14 36/43 |
| 2014/0041256 | A1 | 2/2014 | Espinola | |
| 2014/0123516 | A1 | 5/2014 | Cressman et al. | |
| 2014/0182167 | A1 | 7/2014 | James et al. | |
| 2014/0215770 | A1 | 8/2014 | Levesque et al. | |
| 2014/0237850 | A1 | 8/2014 | Hull | |
| 2014/0259752 | A1 | 9/2014 | Feldman | |
| 2015/0366288 | A1 | 12/2015 | Miller | |
| 2017/0056754 | A1 | 3/2017 | Yu et al. | |
| 2017/0188655 | A1 | 7/2017 | Carlson et al. | |
| 2018/0135213 | A1 | 5/2018 | Bell et al. | |
| 2018/0242694 | A1 | 8/2018 | Webster | |
| 2018/0255872 | A1 | 9/2018 | Manasiya | |
| 2018/0325216 | A1 | 11/2018 | Toronjo | |
| 2019/0297988 | A1 | 10/2019 | Oden et al. | |
| 2019/0380430 | A1 | 12/2019 | Seid | |
| 2020/0008516 | A1 | 1/2020 | Chan et al. | |
| 2020/0046080 | A1 | 2/2020 | Burns et al. | |
| 2020/0253334 | A1 | 8/2020 | Elder et al. | |
| 2020/0352282 | A1 | 11/2020 | Drake | |
| 2020/0367604 | A1 | 11/2020 | Langvin et al. | |
| 2020/0375301 | A1 | 12/2020 | Cheung | |
| 2021/0037912 | A1 | 2/2021 | Spencer | |
| 2021/0204639 | A1 | 7/2021 | Yang | |
| 2021/0219651 | A1 | 7/2021 | Rushbrook et al. | |
| 2021/0227925 | A1 | 7/2021 | Kim | |

FOREIGN PATENT DOCUMENTS

| | | | | |
|---|---|---|---|---|
| CN | 108851327 | A | 11/2018 | |
| CN | 109549280 | A | 4/2019 | |
| GB | 2432295 | A | 5/2007 | |
| KR | 100540394 | A | 12/2005 | |
| WO | WO-9741747 | A1 * | 11/1997 | A43B 7/1465 |
| WO | 2006106612 | A2 | 10/2006 | |

* cited by examiner

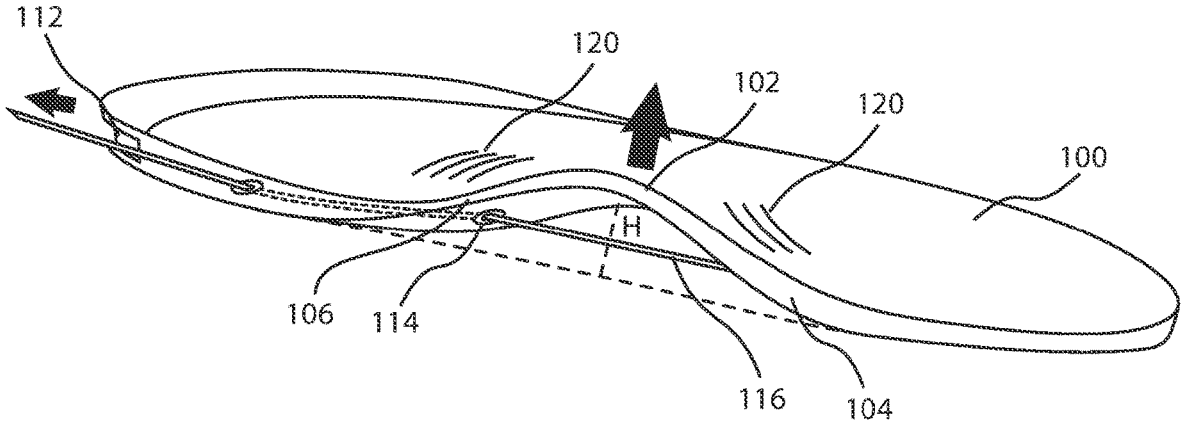
112
120
102
120
100
H
106
114
116
104

ARCH ADJUSTABLE FOOTBEDS FOR FOOTWEAR

CROSS-REFERENCE TO RELATED APPLICATION

This application claims priority to and the benefit of U.S. Provisional Patent Application No. 62/958,302, filed Jan. 7, 2020 and entitled "Arch Adjustable Footbeds for Footwear," which is incorporated herein by reference in its entirety for all purposes.

FIELD

The present disclosure relates to arch adjustable footbeds for footwear.

BACKGROUND

Whether due to growth, pregnancy, injury, swelling or activity (e.g., walking versus running), to name a few, the desired length and/or width of footwear may change over time, and do so before footwear is otherwise "worn out." The present disclosure addresses this need.

SUMMARY

Example embodiments of the present disclosure comprise a footbed for an article of footwear, the footbed comprising an arch portion defined by a curve, wherein a height of the curve is adjustable by a relative movement between a first portion of the arch portion and a second portion of the arch portion to increase or decrease the height of the arch portion.

In accordance with example embodiments, the footbed comprises an elongated element, the elongated element being coupled to an anchor point at the first portion and extending through a channel at the second portion, wherein tension applied to or removed from the elongated element causes the relative movement. In accordance with example embodiments, an end of the elongated element is received in a recess in the footbed.

In accordance with example embodiments, the arch portion is surrounded by one or more folds, pleats or baffles configured to open and close such that an overall length of the footbed is not affected by the relative movement.

BRIEF DESCRIPTION OF THE DRAWINGS

The accompanying drawings may provide a further understanding of example embodiments of the present disclosure and are incorporated in, and constitute a part of, this specification. In the accompanying drawings, only one shoe (either a left shoe or a right shoe) may be illustrated, however, it should be understood that in such instances, the illustrated shoe may be mirror-imaged so as to be the other shoe. The use of like reference numerals throughout the accompanying drawings is for convenience only, and should not be construed as implying that any of the illustrated embodiments are equivalent. The accompanying drawings are for purposes of illustration and not of limitation.

FIG. 1 illustrates an example embodiment of an arch adjustable footbed, in accordance with the present disclosure.

DETAILED DESCRIPTION

Example embodiments of the present disclosure are described in sufficient detail in this detailed description to enable persons having ordinary skill in the relevant art to practice the present disclosure, however, it should be understood that other embodiments may be realized and that mechanical and chemical changes may be made without departing from the spirit or scope of the present disclosure. Thus, this detailed description is for purposes of illustration and not of limitation.

For example, unless the context dictates otherwise, example embodiments described herein may be combined with other embodiments described herein. Similarly, references to "example embodiment," "example embodiments" and the like indicate that the embodiment(s) described may comprise a particular feature, structure, or characteristic, but every embodiment may not necessarily comprise the particular feature, structure, or characteristic. Moreover, such references may not necessarily refer to the same embodiment(s). Any reference to singular includes plural embodiments, and any reference to plural includes singular embodiments.

Any reference to coupled, connected, attached or the like may be temporary or permanent, removeable or not, non-integral or integral, partial or full, and may be facilitated by one or more of adhesives, stitches, hook and loop fasteners, buttons, clips, grommets, zippers and other means known in the art or hereinafter developed.

As used herein, the transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

No claim limitation is intended to invoke 35 U.S.C. 112(f) or pre-AIA 35 U.S.C. 112, sixth paragraph or the like unless it explicitly uses the term "means" and includes functional language.

In describing example embodiments of the arch adjustable footbeds for footwear, certain directional terms may be used. By way of example, terms such as "right," "left," "medial," "lateral," "front," "back," "forward," "backward," "rearward," "top," "bottom," "upper," "lower," "up," "down," and the like may be used to describe example embodiments of the arch adjustable footbeds for footwear. These terms should be given meaning according to the manner in which the arch adjustable footbeds for footwear is most typically designed for use, with the arch adjustable footbeds for footwear on a user's foot and with the user's shod foot disposed on or ready for placement on an underlying surface. Thus, these directions may be understood relative to the arch adjustable footbeds for footwear in such use. Similarly, as the arch adjustable footbeds for footwear is intended primarily for use as footwear, terms such as "inner," "inward," "outer," "outward," "innermost," "outermost," "inside," "outside," and the like should be understood in reference to the arch adjustable footbeds for footwear's intended use, such that inner, inward, innermost, inside, and the like signify relatively closer to the user's foot, and outer, outward, outermost, outside, and the like signify relatively farther from the user's foot when the arch adjustable footbeds for footwear is being used for its intended purpose. Notwithstanding the foregoing, if the foregoing definitional guidance is contradicted by an individual use herein of any of the foregoing terms, the term should be understood and read according to the definition that gives life and meaning to the particular instance of the term.

As used herein, a "footwear" refers to an athleisure shoe, a casual shoe, a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a flip flop, a boot, or other suitable type of shoe. Additionally, footwear can be sized and configured to be worn by men, women, or children.

In accordance with example embodiments, the present disclosure comprises footbeds to provide for arch adjustability of a shoe into which the footbeds are placed.

With reference to FIG. 1, a footbed 100 comprises an arch portion 102, wherein the arch portion 102 is generally defined as a medial portion of the footbed 100 between a forward edge and a rearward edge of the footbed 100 that has some curvature to accommodate the arch of a user's foot. In example embodiments, a dimension of the arch portion 102 (e.g., shape, length, width, height, curvature, etc.) can be adjusted.

In accordance with example embodiments of the present disclosure, a footbed 100 for an article of footwear comprises an arch portion 102 defined by a curve. In such embodiments, a height H (or another dimension) of the curve can be adjusted by a relative movement between a first portion 104 of the arch portion 102 and a second portion 106 of the arch portion 102 to thereby increase or decrease the height H (or another dimension) of the arch portion 102. As used herein, "relative movement" refers to movement of one but not the other, or movement of both.

In example embodiments, the arch portion 102 comprises an anchor point to which an elongated element 116 is coupled.

An anchor point can be located anywhere on an arch portion 102, either on a topside, on an underside, or in between. In example embodiments, an anchor point is located proximal to an edge of the arch portion 102, for example, on a forward edge or a rearward edge of the arch portion 102. An elongated element 116 can comprise a cord, strap, or the like, and have a flat, oval or round cross section, among others. A plurality of anchor points and/or elongated elements are also contemplated herein.

An elongated element can extend from a first anchor point at a first portion 104 of the arch portion 102 to a second anchor point at a second portion 106 of the arch portion 102 (e.g., across a section of the arch portion where it is desirable to adjust a dimension of the arch portion 102). For example, a first portion 104 of the arch portion 102 can be located proximal to a forward edge of an arch portion 102, and a second portion 106 of the arch portion 102 can be located proximal to a rearward edge of an arch portion 102. In such embodiments, tension applied to an elongated element 116 (e.g., by pulling or twisting an end thereof) can draw anchor points toward one another, to thereby adjust a dimension of the arch portion 102.

In other embodiments, rather than extending to a second anchor point, an elongated element can extend from a first anchor point at the first portion 104 of the arch portion 102 to a channel 114 at the second portion 106 of the arch portion 102 (as above, across a section of the arch portion 12 where it is desirable to adjust a dimension of the arch portion 102).

The channel 114 can comprise an aperture through which the elongated element 116 is drawn. In this regard, pulling the elongated element 116 through the channel 114, wherein the elongated element 116 is also coupled to the anchor point, can pull the anchor point closer to the channel 114, to thereby adjust a dimension of the arch.

The channel 114 can further comprise, for example, a clip, hook, or the like for receiving one of a plurality of protuberances or apertures located along a length of the elongated element 116, to thereby select and lock a desired dimension of the arch portion 102.

The channel 114 can extend through a length of footbed 100 from an underside of footbed 100 to a side of footbed 100 (e.g., as illustrated in FIG. 1 with dotted lines). Alternatively, the channel 114 can extend through a length of footbed 100 from an underside of footbed 100 to an underside or topside of footbed 100.

Thus, in accordance with example embodiments of the present disclosure, the footbed 100 can comprise an elongated element 116. In such embodiments, the elongated element 116 can be coupled to an anchor point at the first portion 104 and extend through a channel 114 at the second portion 106. In such embodiments, tension applied to or removed from the elongated element 116 can cause a relative movement between the first portion 104 of the arch portion 102 and the second portion 106 of the arch portion 102 to thereby increase or decrease a dimension (e.g., a height H) of the arch portion 102.

In another embodiment, an application of a tension to an end of the elongated element 116 decreases a width of the curve to increase a height H of the arch portion 102.

An elongated element can comprise one or more visual, tactile or audible indicators of adjustment (e.g., a click every 2 mm or a mark corresponding to 2 mm).

In connection with the foregoing embodiments, an end of the elongated element 116 that is not attached to an anchor point can be located adjacent to a channel 114 (e.g., and engage with an adjustable securement adjacent to the channel 114, or further comprise teeth to engage with a ratchet or zip-tie mechanism or the like adjacent to the channel 114).

In accordance with example embodiments, an end of the elongated element 116 is received in a recess 112 in the footbed 100, for placement when not being used.

The footbed 100 can be used with any article of footwear generally known in the art.

Thus, in some embodiments, an end of the elongated element 116 that is not attached to an anchor point can be threaded through an upper and/or a sole structure of an article of footwear to a point where it can be accessed by a user to apply and release tension (and in some embodiments, to engage with a ratchet or zip-tie mechanism or the like), to thereby adjust a dimension of the arch portion 102. Stated differently, an end of the elongated element 116 can be threaded through the article of footwear to a point where it can be accessed by a user to cause the relative movement between the first portion of the arch portion 102 and the second portion of the arch portion 102. In such embodiments, a user can adjust the arch portion 102 without removing the article of footwear.

In accordance with example embodiments, an end of the elongated element 116 is coupled to a motor. The motor, in turn, may be actuated in a wired or wireless configuration.

In accordance with example embodiments, the arch portion 102 is surrounded by one or more folds, pleats or baffles 120 configured to open and close such that an overall length of the footbed 100 is not affected by a relative movement between a first portion 104 of the arch portion 102 and a second portion 106 of the arch portion 102. In other embodiments, the arch portion 102 can be surrounded by, or comprises of, a material configured to be resiliently deformable.

While the present disclosure has been described primarily with reference to a footbed 100, those skilled in the art will appreciate that the principles of the present disclosure can be applied to any sole structure.

As used herein, "sole structure" refers to an outsole or portions thereof, a midsole or portions thereof, an insole or portions thereof, a wedge or portions thereof, or other suitable structure disposed between and/or adjacent to the foregoing parts of a shoe.

It will be apparent to those skilled in the art that various modifications and variations can be made in the present disclosure without departing from the spirit or scope of the disclosure. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

We claim:

1. A footbed for an article of footwear, the footbed comprising an arch portion defined by a curve, wherein a height of the curve is adjustable by a relative movement between a first portion of the arch portion and a second portion of the arch portion to increase or decrease the height of the arch portion, and wherein the footbed comprises an elongated element, a first end of the elongated element being coupled to an anchor point at the first portion, a first segment of the elongated element extending beneath the arch portion, a second segment of the elongated element extending through a channel in the footbed, the channel having a channel opening at the second portion and a channel exit removed from the arch portion, and a second end of the elongated element removed from the channel, wherein tension applied to the second end of the elongated element pulls at least a portion of the first segment of the elongated element into the channel to thereby bring the first portion of the arch portion and the second portion of the arch portion closer to one another.

2. The footbed of claim 1, wherein the channel extends through a length of the footbed from an underside of the footbed to a sidewall of the footbed.

3. The footbed of claim 1, wherein the second end of the elongated element is received in a recess in the footbed.

4. The footbed of claim 1, wherein the second end of the elongated element is threaded through the article of footwear to a point where it can be accessed by a user to cause the relative movement between the first portion of the arch portion and the second portion of the arch portion such that the user can adjust the arch portion without removing the article of footwear.

5. The footbed of claim 1, wherein the arch portion comprises one or more folds, pleats or baffles configured to open and close such that an overall length of the footbed is not affected by the relative movement between the first portion of the arch portion and the second portion of the arch portion.

6. An article of footwear comprising a footbed having an arch portion defined by a curve, wherein a height of the curve is adjustable by a relative movement between a first portion of the arch portion and a second portion of the arch portion to increase or decrease the height of the arch portion, wherein the footbed comprises an elongated element, a first end of the elongated element being coupled to an anchor point at the first portion, a segment of the elongated element extending beneath the arch portion, and a second end of the elongated element extending through a channel having a channel opening at the second portion, wherein a pulling force applied to the second end of the elongated element against the anchor point brings the first portion of the arch portion and the second portion of the arch portion closer to one another, and wherein the second end of the elongated element is threaded through the article of footwear to a point where it can be accessed by a user to cause the relative movement between the first portion of the arch portion and the second portion of the arch portion such that the user can adjust the arch portion without removing the article of footwear.

7. The article of footwear of claim 6, wherein the arch portion of the footbed comprises one or more folds, pleats or baffles configured to open and close such that an overall length of the footbed is not affected by the relative movement between the first portion of the arch portion and the second portion of the arch portion.

8. A footbed for an article of footwear, the footbed having an elongated element attached to an anchor point, and an arch portion defined by a curve, a segment of the elongated element extending completely through a channel in the footbed, a channel exit of the channel being removed from the arch portion, wherein an application of a tension to an end of the elongated element decreases a width of the curve to increase a height of the arch portion, and wherein the tension results in a pulling force at the anchor point.

9. The footbed of claim 8, wherein the end of the elongated element is received in a recess in the footbed.

10. The footbed of claim 8, wherein the end of the elongated element is threaded through the article of footwear to a point where it can be accessed by a user to cause the application of the tension such that the user can adjust the arch portion without removing the article of footwear.

11. The footbed of claim 8, wherein the arch portion comprises one or more folds, pleats or baffles configured to open and close such that an overall length of the footbed is not affected by the application of the tension.

* * * * *